US007493028B2

(12) United States Patent
DeWitt et al.

(10) Patent No.: US 7,493,028 B2
(45) Date of Patent: Feb. 17, 2009

(54) MULTIPLE BOTTLE EVAPORATIVE DIFFUSER

(75) Inventors: T. Scott DeWitt, Syracuse, IN (US); Robert G. Cox, Goshen, IN (US)

(73) Assignee: Group Dekko, Inc., Kendallville, IN (US)

( * ) Notice: Subject to any disclaimer, the term of this patent is extended or adjusted under 35 U.S.C. 154(b) by 164 days.

(21) Appl. No.: 11/397,532

(22) Filed: Apr. 4, 2006

(65) Prior Publication Data

US 2007/0237499 A1 Oct. 11, 2007

(51) Int. Cl.
*F24F 6/08* (2006.01)

(52) U.S. Cl. ..... 392/395; 392/386

(58) Field of Classification Search ..... 392/395
See application file for complete search history.

(56) References Cited

U.S. PATENT DOCUMENTS

| | | | | |
|---|---|---|---|---|
| 4,629,604 | A | 12/1986 | Spector | 422/124 |
| 4,948,948 | A * | 8/1990 | Lesage | 392/454 |
| 5,007,103 | A * | 4/1991 | Tyrrell et al. | 392/365 |
| 5,805,768 | A | 9/1998 | Schwartz et al. | 392/390 |
| 6,240,248 | B1 | 5/2001 | Fore | 392/386 |
| 6,487,367 | B2 | 11/2002 | Vieira | 392/395 |
| 6,501,906 | B2 | 12/2002 | Vieira | 392/395 |
| 6,554,203 | B2 | 4/2003 | Hess et al. | 239/69 |
| 6,563,091 | B2 | 5/2003 | Vieira | 219/486 |
| 6,581,915 | B2 | 6/2003 | Bartsch et al. | 261/26 |
| 6,790,408 | B2 | 9/2004 | Whitby et al. | 422/4 |
| 6,859,615 | B2 | 2/2005 | Yip et al. | 392/395 |
| 6,909,840 | B2 | 6/2005 | Harwig et al. | 392/405 |
| 6,950,607 | B2 * | 9/2005 | Yip et al. | 392/395 |
| 2002/0146242 | A1 * | 10/2002 | Vieira | 392/395 |
| 2004/0024496 | A1 | 2/2004 | Young et al. | 700/300 |
| 2004/0247301 | A1 * | 12/2004 | Yip et al. | 392/395 |
| 2005/0094988 | A1 * | 5/2005 | Yip et al. | 392/395 |
| 2007/0280653 | A1 * | 12/2007 | Viera | 392/395 |

FOREIGN PATENT DOCUMENTS

| | | |
|---|---|---|
| WO | 03/028775 | 4/2003 |
| WO | 2004/096300 | 11/2004 |

* cited by examiner

*Primary Examiner*—Thor S Campbell
(74) *Attorney, Agent, or Firm*—Taylor & Aust, P.C.

(57) ABSTRACT

A vaporization device including a housing, a plurality of wicks, a plurality of heating elements and a power control circuit. The plurality of wicks are at least partially contained within the housing and include a first wick and a second wick. The plurality of heating elements include a first heating element and a second heating element. The first heating element is proximate to the first wick and the second heating element is proximate to the second wick. The power control circuit powers the first heating element at a first level when the second heating element is not powered. The power control circuit powers the first heating element at a second level when the second heating element is powered.

13 Claims, 4 Drawing Sheets

MULTIPLE BOTTLE EVAPORATIVE DIFFUSER

BACKGROUND OF THE INVENTION

1. Field of the Invention

The present invention relates to a wick vaporization system, and, more particularly, to a multiple. wick vaporization system using heating elements.

2. Description of the Related Art

An electrically heated chemical delivery system, which is connectable with an electrical receptacle, is known. For example, it is known to provide a housing, which directly carries a pair of terminals, which extend therefrom and may be plugged into a conventional 115 volt electrical receptacle. The electrical terminals are electrically connected to a heater disposed within the body of the delivery system. A heat actuated chemical is disposed within the body and releases its gases into the ambient environment with the heat that is supplied accelerating the release.

One method used to alter the amount of vaporizable material that is released in the environment is to control the airflow around the heating element and/or wick. Controlling the airflow requires adjustable elements in the housing to alter the airflow that passes by the vaporizable material.

Another method of controlling the vaporization of the vaporizable material is to alter the wick position relative to the heating element. This includes mechanical adjustment of the position of the wick relative to the heater or the extending of the wick past the heater.

The compact design of a diffuser system often places the heating elements and the wicks in close proximity to each other. The proximity of the heating elements for one wick can accelerate the vaporization of material from another wick. A problem often occurs if multiple heaters are utilized to accelerate vaporization of materials from multiple wicks, in that the total heat delivered for the vaporization process causes an excessive amount of material to be delivered to the ambient environment.

What is needed in the art is a method to control the total diffused material coming from a vaporization diffusion device.

SUMMARY OF THE INVENTION

The present invention provides a vaporization system that controls the vaporization rate of multiple wick system.

The invention comprises, in one form thereof, a vaporization device including a housing, a plurality of wicks, a plurality of heating elements and a power control circuit. The plurality of wicks are at least partially contained within the housing and include a first wick and a second wick. The plurality of heating elements include a first heating element and a second heating element. The first heating element is proximate to the first wick and the second heating element is proximate to the second wick. The power control circuit powers the first heating element at a first level when the second heating element is not powered. The power control circuit powers the first heating element at a second level when the second heating element is powered.

An advantage of the present invention is that the vaporization rate of material in the multiple wick system is balanced when more than one wick is being utilized for the vaporization of material.

Another advantage of the present invention is that the vaporization rate of one vaporizable material is not overdriven when more than one heating element for separate wicks are energized.

Yet another advantage of the present invention is that an average power is controllably delivered to the heating element, which results in simpler switching mechanisms.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
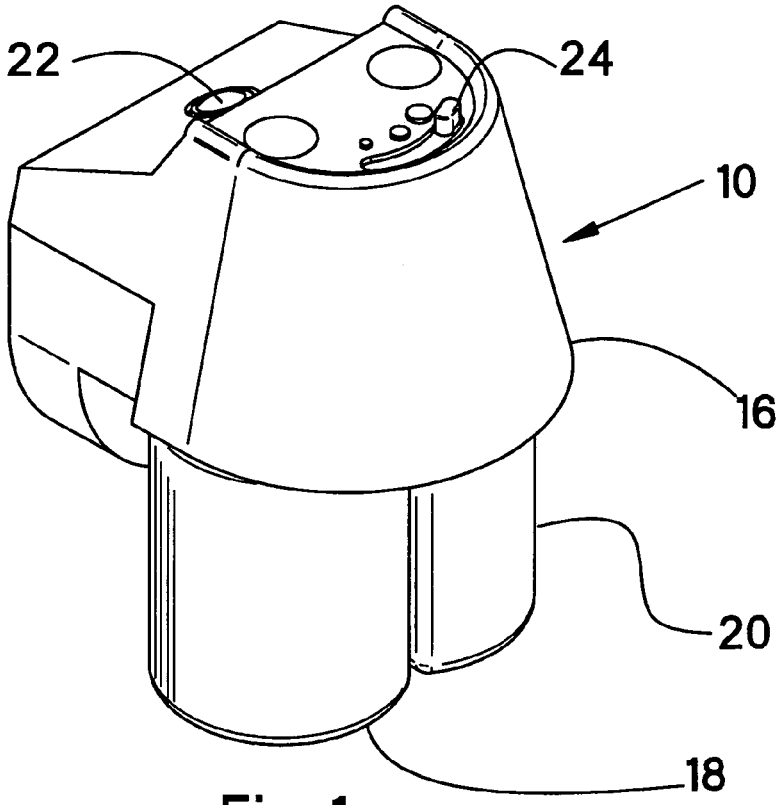
FIG. 1 is a perspective view of a multi wick vaporization device of the present invention.

Referring now to the drawings, and more particularly to FIGS. 1-4, there is shown a vaporization device 10, which generally includes electrical terminals 12 that are attached to a rotary interface located at 14, a housing 16, a first bottle 18 and a second bottle 20. Housing 16 includes a circuit assembly that is electrically connected to electrical terminals 12. Electrical terminals 12 are mounted to the rotary interface, which rotates about an axis allowing the repositioning of electrical terminals 12 so that housing 16 may remain vertically oriented regardless of the orientation of the electrical receptacle into which vaporization device 10 is plugged. Housing 16 has a somewhat conical shaped outer housing with a top surface having multiple vents, each vent being associated with a wick.

On a portion of housing 16 there is included a pushbutton 22 and an airflow adjustor 24. Airflow adjustor 24 functions to alter the flow through vaporization device 10. Pushbutton 22 interfaces with the electrical circuit assembly, thereby allowing a selection of multiple modes of operation.

Figure 2:
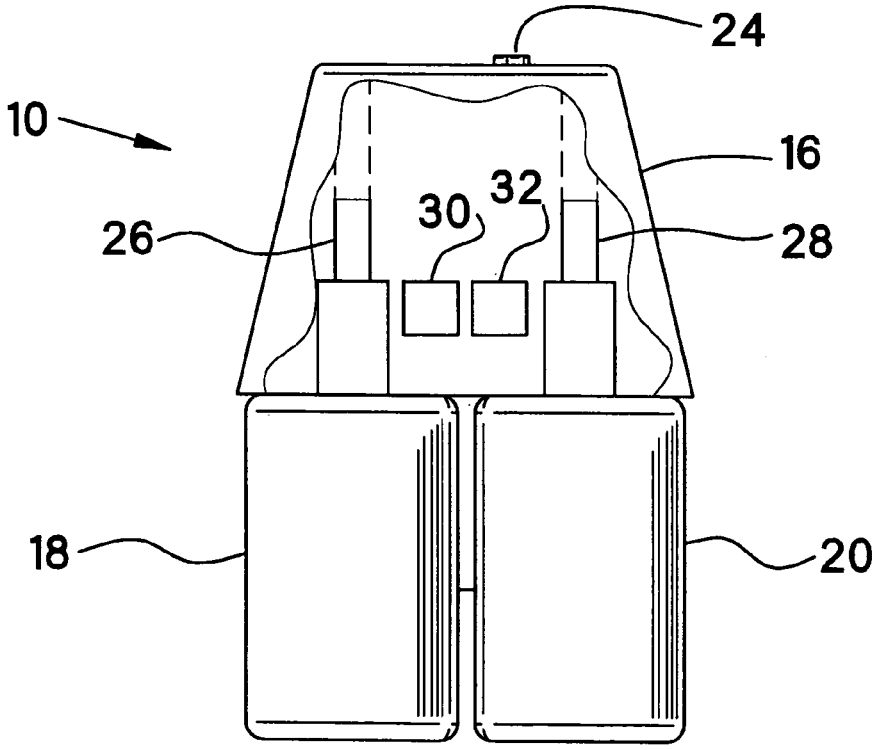
FIG. 2 is a partially sectioned front view of the vaporization device of FIG. 1.
Figure 3:
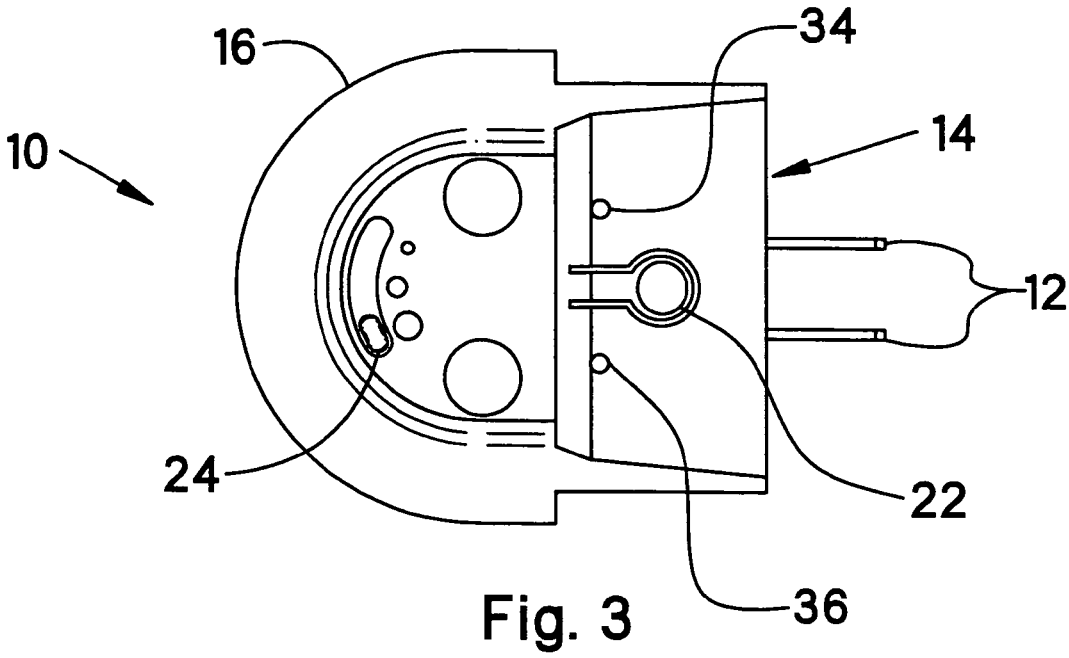
FIG. 3 is a top view of the vaporization device of FIGS. 1 and 2.
Figure 4:
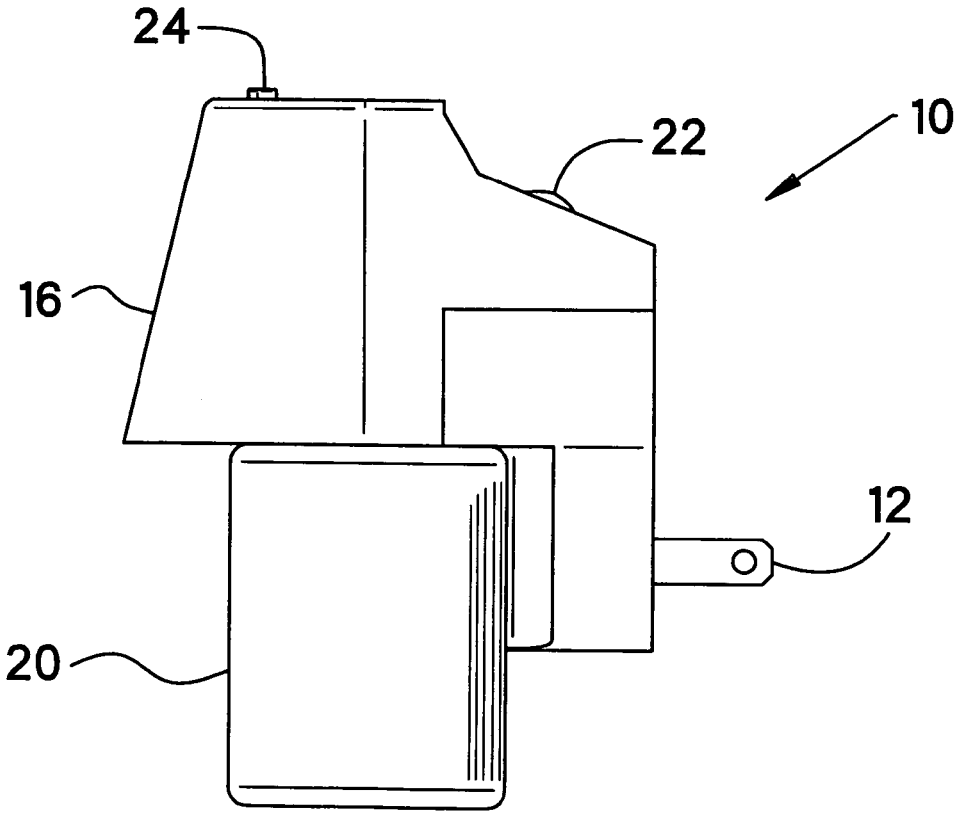
FIG. 4 is a side view of the vaporization device of FIGS. 1-3.

Internal to housing 16 and associated with first bottle 18 and second bottle 20 are respectively first wick 26 and second wick 28. First wick 26 is fluidly coupled with material in first bottle 18. In a like manner second wick 28 is fluidly connected with material in second bottle 20. Material in first bottle 18 and second bottle 20 are conveyed by wicks 26 and 28 causing material to be drawn from bottles 18 and 20 and respectively positioned proximate to a first heater 30 and a second heater 32. Heaters 30 and 32 may be resistors 30 and 32 that have the same resistance value. For purposes of clarity, heaters 30 and 32 are schematically shown in FIG. 2 as being between wicks 26 and 28; however, heaters 30 and 32 may be located elsewhere, such as, behind, in front of or to the outside of wicks 26 and 28. Although heaters 30 and 32 are respectively closest to wicks 26 and 28, heat conveyed from either heater 30 or 32 also has an influence on the wick that is not proximate to a specific heater. For example, heat supplied by first heater 30 primarily influences the material in first wick 26. However, some of the heat may also affect the material in second wick 28 to a significantly lesser degree when first heater 30 and second heater 32 are both activated. The heat from the two heaters causes the vaporization of the material in each of the wicks to be higher than if only one of heaters 30 or 32 is activated. For example, if heaters 30 and 32 are activated at the same level as heater 30 and 32 would be when separately activated, the total heat dissipation within housing 16 is higher, causing the vaporization from wicks 26 and 28 to exceed that which would have been drawn from each wick if only one heater had been activated.

The present invention alters this activity and compensates the heat dissipated by heaters 30 and 32 when both heaters 30 and 32 are activated. For example, when it is desired to vaporize material from both bottle 18 and bottle 20, heater 30 and heater 32 produce a reduced amount of heat as compared to when only material from either bottle 18 or bottle 20 is being vaporized.

Indicators 34 and 36 are positioned so as to infer that indicator 34 is associated with bottle 18 and indicator 36 is associated with bottle 20. This association allows an operator to visually perceive the activation scenario. For example, indicator 34 is illuminated when power is being supplied to heater 30 and material from bottle 18 is being vaporized.

Figure 5:
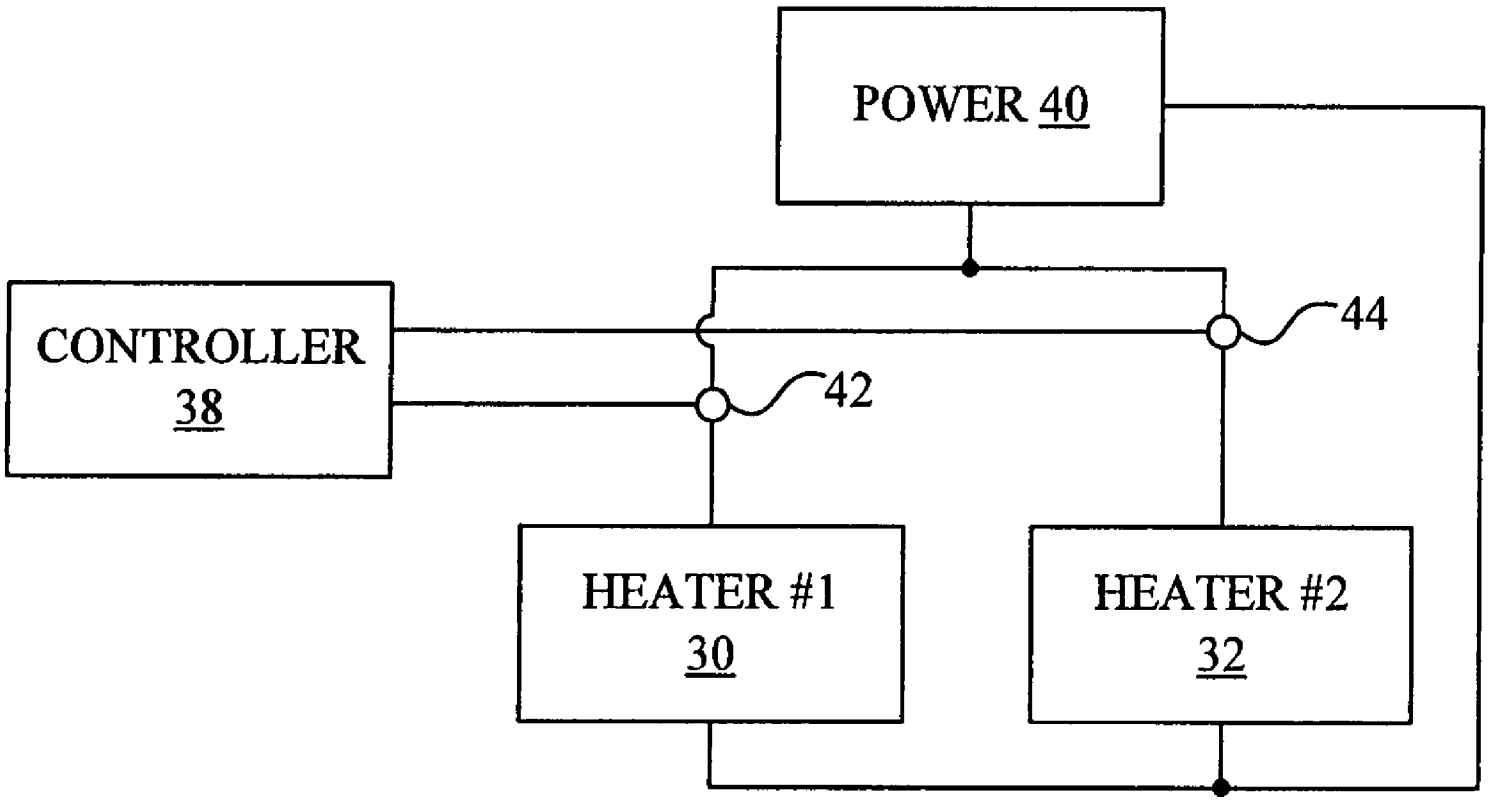
FIG. 5 is a schematical representation of a control system of one embodiment of the present invention.
Figure 6:
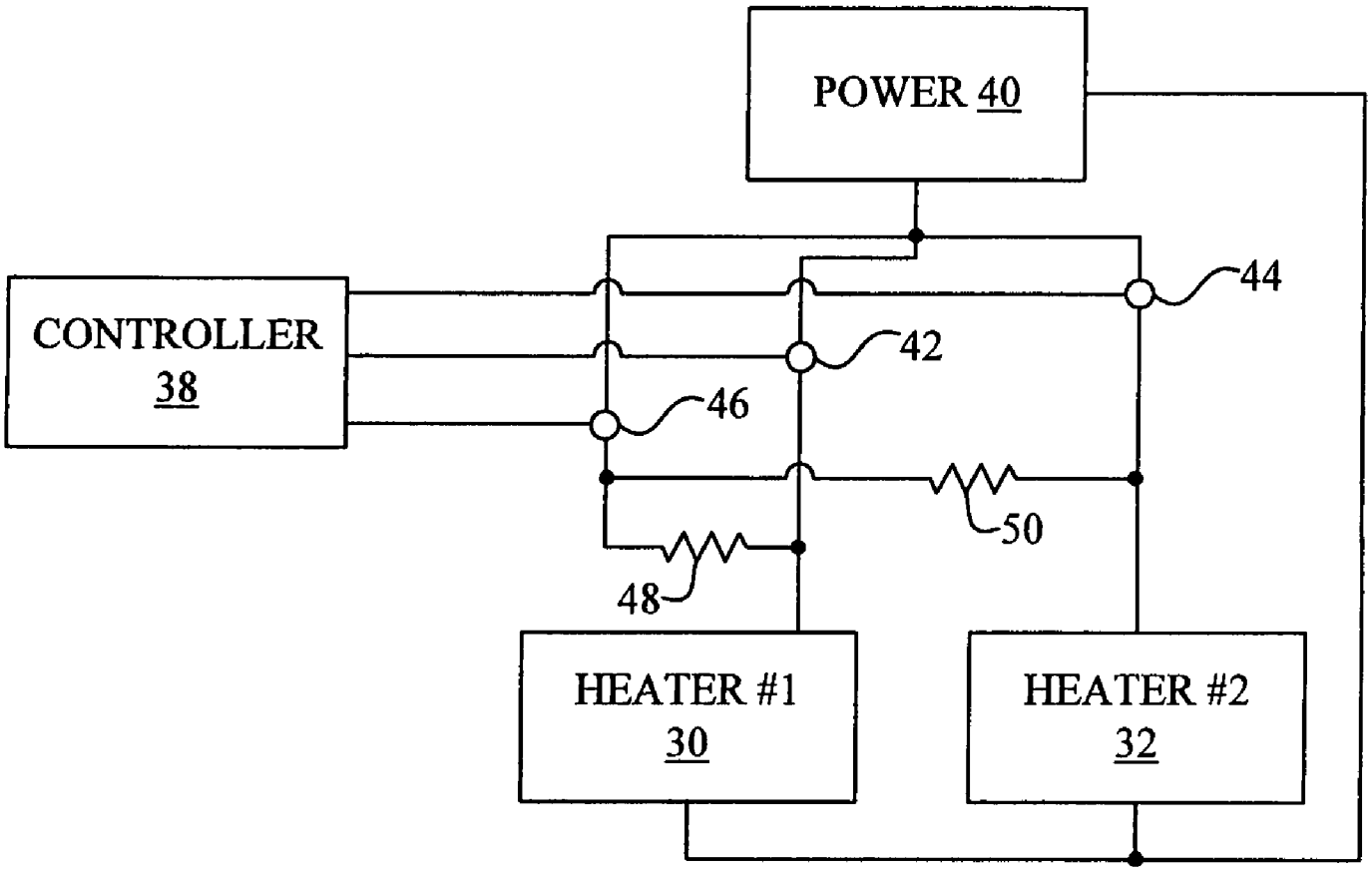
FIG. 6 is a schematical representation of a control system of another embodiment of the present invention.

Now, additionally referring to FIGS. 5 and 6 there is schematically illustrated two embodiments of the control system of the present invention. A controller 38 causes power from power source 40 to be selectively supplied to heaters 30 and 32 by the way of switches 42, 44 and 46, also known as transistors 42, 44 and 46, for the selective powering of heater 30 and heater 32.

Now, specifically referring to the circuit of FIG. 5, controller 38 selectively turns on transistors 42 and 44 to control the power from power source 40 being applied to heaters 30 and 32.

Several modes of operation are possible with the present invention. For purposes of clarity the changing of the modes may be in any order even though an order is presented in this example. Further, it is to be understood that the various modes are selected by pressing pushbutton 22 causing a sequential selection of modes.

When vaporization device 10 is plugged into an electrically active outlet a default mode is entered. The default mode may be heaters 30 and 32 both being supplied power. In this mode indicators 34 and 36 are both illuminated continuously. Both heater 30 and heater 32 are activated simultaneously, but at a lower level than a high level when only one of heaters 30 and 32 are activated. For purposes of reference, this will be referred to as a low level. The low level of heat supplied to both heaters 30 and 32 simultaneously advantageously prevents or reduces a symbiotic relationship if heaters 30 and 32 were both powered at a high level causing the vaporization rates of materials in bottle 18 and 20 to be higher than when there each separately activated.

A press of pushbutton 22 causes vaporization device 10 to increment to a mode where only heater 30 is activated. Indicator 34 is illuminated continuously and indicator 36 is not illuminated. The heat supplied to heater 30 is at a high level than the low level.

A second press of pushbutton 22 causes vaporization device 10 to increment to a mode where only heater 32 is energized. Indicator 36 is illuminated continuously and indicator 34 is not illuminated. Power supplied by way of power source 40 to heater 32 is at a high level similar to the previous mode.

A third press of pushbutton 22 causes vaporization device 10 to increment to an alternating mode where first heater 30 is energized for a period of time after which heater 32 is energized for a period of time. Both heater 30 and heater 32 are activated at a high level when they are alternatively activated. Indicators 34 and 36 are likewise alternatingly illuminated to correspond to the activation of heater 30 and heater 32 respectively.

A further press of pushbutton 22 return vaporization device 10 to its default mode.

Additional modes are contemplated such as heater 30 being on continuously with heater 32 intermittently turning off and on at a predetermined time interval. In a like manner heater 32 can be on continuously with heater 30 turning off and on at predetermined time intervals. Another mode of operation is for heaters 30 and 32 to turn on for some time period simultaneously or with some time lag, and then off for some time period simultaneously or with some time lag associated between the two heaters. Further, the power supplied to heaters 30 and 32 could be varied with numerous time schemes so that chemical diffusion rates from wicks 26 and 28 are varied over a predetermined time period. A further mode is a randomization mode, which can be used to change between any operation mode and any time parameter so that the diffusion rate of either when the materials in bottles 18 and 20 would be unpredictable and of a random nature. Having multiple operation modes allows the consumer to tailor their experience with the diffusion chemical and provides the opportunity to overcome the habituation that occurs as a consumer experiences a diminished response with a particular diffused chemical over time.

Controller 38 can cause an average power to be dissipated selectively in heaters 30 and 32. The term average power is to be understood that controller 38 would supply power to heater 30 and/or heater 32 for an extended period, which can be at least one second, several seconds or several tens of seconds long. While the selective control of power supplied to heaters 30 and 32 could be on a much shorter time scale, such as individual cycles of the alternating current supplied by way of electrical terminals 12. This type of control is not necessary since the heat supplied to the materials that have wicked into wicks 26 and 28 can be simply an averaging amount of heat supplied by way of heaters 30 and 32. In this manner when a mode is selected in which heaters 30 and 32 are both activated a low level of power is supplied by reducing the average power dissipated by both heaters 30 and 32.

Now, specifically referring to the schematical representation of an embodiment of the present invention in FIG. 6, there are additionally shown resistors 48 and 50. In this embodiment power is supplied to just heater 30 or heater 32, when transistors 42 or 44 are, respectively, turned on in a continuous manner. If power is to be supplied to both heaters 30 and 32 then transistor 46 is activated, rather than transistors 42 or 44, thereby reducing the power flow through heaters 30 and 32 due to the current dropping effect of the additional resistance of resistors 48 and 50. The total power dissipated, when transistor 46 is activated, is reduced over that which would be supplied by heaters 30 and 32 if both transistors 42 and 44 were activated.

Advantageously, the present invention greatly reduces the symbiotic effect of multiple heaters proximate to wicks that are closely spaced within a vaporization device.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A vaporization device, comprising:

a housing;

a plurality of wicks at least partially contained within said housing including a first wick and a second wick;

a plurality of heating elements including a first heating element and a second heating element, said first heating element proximate to said first wick, said second heating element proximate to said second wick, said plurality of heating elements being in an electrically parallel relationship; and a power control circuit powering said first heating element at a first average power level when said second heating element is substantially not powered, said power control circuit powering said first heating element at a second average power level when said second heating element is powered.

2. The vaporization device of claim 1, wherein said first average power level and said second average power level are average power levels determined over at least one second.

3. The vaporization device of claim 1, wherein said second heating element is powered at substantially said second average power level when said first heating element is powered at said second average power level, said first average power level being greater than said second average power level.

4. The vaporization device of claim 3, further comprising a selector controllably connected to said power control circuit, said selector setting determining whether said first heating element and said second heating element are powered.

5. The vaporization device of claim 4, wherein said selector selects one of a plurality of modes including a heating of said first wick mode, a heating of said second wick mode and a heating of both said first wick and said second wick mode.

6. The vaporization device of claim 5, wherein said heating of said first wick mode and said heating of said second wick mode respectively causes said first average power level of heating to occur in said first heating element and said first average power level of heating to occur in said second heating element.

7. The vaporization device of claim 6, wherein said second wick receives some heat from said first heating element when said first heating element is powered.

8. A method controlling the vaporization rates of a multi-wick device, comprising the steps of:

positioning a plurality of wicks in a housing, including a first wick and a second wick;

supplying a first average power level to a first heating element proximate to said first wick when no power is supplied to a second heating element proximate to said second wick; and supplying a second average power level to said first heating element when power is supplied to said second heating element, said second average power level being lower than said first average power level, said first average power level and said second average power level being determined over at least one second.

9. The method of claim 8, further comprising the step of supplying said second heating element at approximately said second average power level when said first heating element is powered at said second average power.

10. The method of claim 8, further comprising the step of selecting to power one of said first heating element, said second heating element, and both said first heating element and said second heating element.

11. The method of claim 10, wherein if said selecting step is to power said first heating element said first average power level is supplied to said first heating element, if said selecting step is to power said second heating element said first average power level is supplied to said second heating element, if said selecting step is to power both said first heating element and said second heating element said second average power level is supplied to both said first heating element and said second heating element.

12. The method of claim 11, wherein said second average power level is less that said first average power level.

13. The method of claim 12, wherein said first wick receives some heat from said second heating element when said second heating element if powered.

* * * * *